US009340862B2

(12) United States Patent
Sato et al.

(10) Patent No.: US 9,340,862 B2
(45) Date of Patent: May 17, 2016

(54) POWDER FOR THERMAL SPRAYING

(75) Inventors: Kazuto Sato, Kakamigahara (JP); Haruhiko Furukawa, Gifu (JP)

(73) Assignee: Fujimi Incorporated (JP)

( * ) Notice: Subject to any disclaimer, the term of this patent is extended or adjusted under 35 U.S.C. 154(b) by 1049 days.

(21) Appl. No.: 13/394,321

(22) PCT Filed: Sep. 2, 2010

(86) PCT No.: PCT/JP2010/065007
§ 371 (c)(1),
(2), (4) Date: Jul. 17, 2012

(87) PCT Pub. No.: WO2011/027814
PCT Pub. Date: Mar. 10, 2011

(65) Prior Publication Data

US 2013/0040065 A1 Feb. 14, 2013

(30) Foreign Application Priority Data

Sep. 7, 2009 (JP) ..... 2009-205991
Mar. 10, 2010 (JP) ..... 2010-053378

(51) Int. Cl.

| | |
|---|---|
| ***C22C 29/06*** | (2006.01) |
| ***C22C 29/08*** | (2006.01) |
| ***C23C 4/06*** | (2006.01) |
| ***B22F 3/115*** | (2006.01) |
| ***C23C 4/04*** | (2006.01) |
| ***C23C 24/04*** | (2006.01) |
| *B22F 1/00* | (2006.01) |

(52) U.S. Cl.
CPC . *C23C 4/06* (2013.01); *B22F 3/115* (2013.01); *C22C 29/06* (2013.01); *C22C 29/08* (2013.01); *C23C 4/04* (2013.01); *C23C 24/04* (2013.01); *B22F 1/0096* (2013.01)

(58) Field of Classification Search
CPC ..... C22C 38/32
See application file for complete search history.

(56) References Cited

U.S. PATENT DOCUMENTS

| | | | | |
|---|---|---|---|---|
| 5,302,414 | A * | 4/1994 | Alkhimov et al. | 427/192 |
| 5,643,531 | A | 7/1997 | Kim et al. | |
| 6,613,120 | B2 * | 9/2003 | Ando et al. | 75/246 |
| 7,094,473 | B2 * | 8/2006 | Takayama et al. | 428/545 |

FOREIGN PATENT DOCUMENTS

| | | | | |
|---|---|---|---|---|
| GB | 2285263 | A | 7/1995 | |
| JP | 61-119657 | A | 6/1986 | |
| JP | 61-270302 | A | 11/1986 | |
| JP | 01-230759 | A | 9/1989 | |
| JP | 7-278756 | A | 10/1995 | |
| JP | 8-311635 | A | 11/1996 | |
| JP | 10-88311 | A | 4/1998 | |
| JP | 10-195625 | A | 7/1998 | |
| JP | 11-286767 | A | 10/1999 | |
| JP | 2004-019490 | A | 1/2004 | |
| JP | 2004-027289 | A | 1/2004 | |
| JP | 2004019490 | A * | 1/2004 | F04D 29/04 |
| JP | 2008-231527 | A | 10/2008 | |

OTHER PUBLICATIONS

Machine translation of JP 2004019490 A.*
"Japanese Application Serial No. 2010-053378, Office Action mailed Jun. 25, 2013", 2 pgs.
"International Application Serial No. PCT/JP2010/065007, International Preliminary Report on Patentability dated Apr. 11, 2012", (w/ English Translation of Written Opinion), 5 pgs.
"International Application Serial No. PCT/JP2010/065007, Written Opinion mailed Oct. 12, 2010", (w/ English Translation), 7 pgs.
"International Application Serial No. PCT/JP2010/065007, International Search Report mailed Oct. 12, 2010", (w/ English Translation), 3 pgs.
Japanese Application Serial No. 2013-220187, Office Action mailed Aug. 12, 2014, 3 pgs.

* cited by examiner

*Primary Examiner* — George Wyszomierski
(74) *Attorney, Agent, or Firm* — Schwegman Lundberg & Woessner, P.A.

(57) ABSTRACT

Disclosed is a thermal spray powder of granulated and sintered cermet particles, which contains tungsten carbide or chromium carbide, and a silicon-containing iron-based alloy. The content of the alloy in the thermal spray powder is preferably 5 to 40% by mass. In this case, the alloy contains silicon in a content of 0.1 to 10% by mass.

14 Claims, No Drawings

POWDER FOR THERMAL SPRAYING

This application is a nationalization under 35 U.S.C. 371 from International Patent Application Serial No. PCT/JP2010/065007, filed Sep. 2, 2010 and published as WO 2011/027814 A1 on Mar. 10, 2011, which claims the priority benefit of Japan Application Serial No. 2009-205991, filed Sep. 7, 2009 and Japan Application Serial No. 2010-053378, filed Mar. 10, 2010, the contents of which applications and publication are incorporated herein by reference in their entirety.

TECHNICAL FIELD

The present invention relates to a thermal spray powder of granulated and sintered cermet particles.

BACKGROUND ART

In order to impart characteristics such as abrasion resistance, heat resistance, and corrosion resistance to metal parts of various industrial machines or general-purpose machines, a thermal spray coating has been conventionally provided on the surface of parts. As a material for forming the thermal spray coating, a cermet powder is well known, which at least contains a ceramic such as Lungsten carbide and cobalt as its main components (e.g., see Patent Documents 1 and 2). Compared with other metals, cobalt has an excellent ability as a binder to bind ceramic particles in a thermal spray powder. Therefore, a thermal spray coating formed from a cermet powder containing cobalt is excellent in hardness, abrasion resistance, heat resistance, and corrosion resistance, compared with a thermal spray coating formed from a cermet powder containing other metals. While cobalt is, however, essential in modern society as a material for a secondary battery of an electronic device, cemented carbide or the like, it is traded at a high price because its suppliers are unevenly located and are unstable politically and economically. At the same time, the price of cobalt varies unstably because its production is low. This is one reason for an increase in the price of the cermet powder containing cobalt. Therefore, there has been a need for developing a new cermet powder that can forma thermal spray coating having performance equal to or superior to that of the thermal spray coating formed from the cermet powder containing cobalt while containing a metal that is a substitute for cobalt and is stably lower in price, higher in production, and thus can be stably supplied, compared with cobalt.

PRIOR ART DOCUMENTS

Patent Document 1: Japanese Laid-Open Patent Publication No. 8-311635

Patent Document 2: Japanese Laid-Open Patent Publication No. 10-88311

SUMMARY OF THE INVENTION

Problems that the Invention is to Solve

Accordingly, it is an objective of the present invention to provide a thermal spray powder that can form a thermal spray coating having performance equal to or superior to that of the thermal spray coating formed from the cermet powder containing cobalt while containing a metal that is a substitute for cobalt and is stably lower in price, higher in production, and thus can be stably supplied, compared with cobalt.

Means for Solving the Problems

In order to achieve the objective, and in accordance with one aspect of the present invention, a thermal spray powder of granulated and sintered cermet particles is provided. The powder contains tungsten carbide or chromium carbide, and a silicon-containing iron-based alloy.

The content of the alloy in the thermal spray powder is preferably 5 to 40% by mass. In this case, the alloy contains silicon in a content of 0.1 to 10% by mass.

The alloy may further contain 0.5 to 20% by mass of chromium. Alternatively or additionally, the alloy may further contain 5 to 20% by mass of nickel. Alternatively or additionally, the alloy may further contain at least any one of aluminum, molybdenum, and manganese.

The tungsten carbide or chromium carbide preferably accounts for the balance of the thermal spray powder excluding the alloy.

Effects of the Invention

According to the present invention, a thermal spray powder is provided that can form a thermal spray coating with performance equal to or superior to that of the thermal spray coating formed from the cermet powder containing cobalt while containing a metal that is a substitute for cobalt and is stably lower in price, higher in production, and thus can be stably supplied, compared with cobalt.

MODES FOR CARRYING OUT THE INVENTION

Hereinafter, one embodiment of the present invention will be described.

A thermal spray powder according to the present embodiment includes granulated and sintered particles of cermet (hereinafter, referred also as to "granulated and sintered cermet particles"). The granulated and sintered cermet particles are produced by granulating a mixture of ceramic particles and metal particles, and sintering the obtained granulated product (granules). Therefore, the respective granulated and sintered cermet particles are composite particles obtained by agglomerating the ceramic particles and the metal particles.

The ceramic particles include at least any one of tungsten carbide and chromium carbide, and preferably include tungsten carbide. That is, the thermal spray powder contains at least any one of tungsten carbide and chromium carbide, and preferably includes tungsten carbide, as a ceramic component.

The metal particles include a silicon-containing iron-based alloy. That is, the thermal spray powder contains a silicon-containing iron-based alloy as a metal component. The silicon-containing iron-based alloy may contain a metal other than silicon, such as chromium, nickel, aluminum, molybdenum, and manganese.

The content of the metal component in the thermal spray powder is preferably 5% by mass or more, more preferably 10% by mass or more, and further preferably 12% by mass or more. In other words, the content of the ceramic component in the thermal spray powder is preferably 95% by mass or less, more preferably 90% by mass or less, and further preferably 88% by mass or less. As the content of the metal component in the thermal spray powder increases, the brittleness of the thermal spray coating formed from the thermal spray powder tends to decrease. The thermal spray coating with a lower brittleness generally has a higher abrasion resistance. In this regard, when the content of the metal component in the thermal spray powder is 5% by mass or more, and more specifically 10% by mass or more, or 12% by mass or more (in other words, when the content of the ceramic component in the thermal spray powder is 95% by mass or less, and more specifically 90% by mass or less, or 88% by mass or less), the abrasion resistance of the thermal spray coating is easily improved to a level that is particularly suitable in practice.

On the other hand, the content of the metal component in the thermal spray powder is preferably 40% by mass or less, and more preferably 30% by mass or less. In other words, the content of the ceramic component in the thermal spray powder is preferably 60% by mass or more, and more preferably 70% by mass or more. As the content of the metal component in the thermal spray powder decreases, the hardness of the thermal spray coating formed from the thermal spray powder tends to increase. The thermal spray coating with an increased hardness generally has a higher abrasion resistance. In this regard, when the content of the metal component in the thermal spray powder is 40% by mass or less, and more specifically 30% by mass or less (in other words, when the content of the ceramic component in the thermal spray powder is 60% by mass or more, and more specifically 70% by mass or mere), the abrasion resistance of the thermal spray coating is easily improved to a level that is particularly suitable in practice.

The content of silicon in the iron-based alloy included in the thermal spray powder as a metal component is preferably 0.1% by mass or more, and more preferably 1% by mass or more. As the content of silicon in the iron-based alloy increases, the melting point of the iron-based alloy decreases, and additionally the lubricity and the corrosion resistance of the thermal spray coating formed from the thermal spray powder tend to improve. In this regard, when the content of silicon in the iron-based alloy is 0.1% by mass or more, and more specifically 1% by mass or more, the lubricity and the corrosion resistance of the thermal spray coating are easily improved to a level that is particularly suitable in practice.

On the other hand, the content of silicon in the iron-based alloy is preferably 10% by mass or less, and more preferably 7% by mass or less. As the content of silicon in the iron-based alloy decreases, the toughness of the thermal spray coating formed from the thermal spray powder increases, and as a result, the abrasion resistance of the thermal spray coating tends to improve. In this regard, when the content of silicon in the iron-based alloy is 10% by mass or less, and more specifically 7% by mass or less, the abrasion resistance of the thermal spray coating is easily improved to a level that is particularly suitable in practice.

When the iron-based alloy contains chromium, the content of chromium in the iron-based alloy is preferably 0.5% by mass or more, more preferably 1% by mass or more, and further preferably 5% by mass or more. As the content of chromium in the iron-based alloy increases, the corrosion resistance of the thermal spray coating formed from the thermal spray powder tends to improve. In this regard, when the content of chromium in the iron-based alloy is 0.5% by mass or more, and more specifically 1% by mass or more, or 5% by mass or more, the corrosion resistance of the thermal spray coating is easily improved to a level that is particularly suitable in practice.

On the other hand, the content of chromium in the iron-based alloy is preferably 20% by mass or less, and more preferably 18% by mass or less. As the content of chromium in the iron-based alloy decreases, the toughness of the thermal spray coating formed from the thermal spray powder increases, and as a result, the abrasion resistance of the thermal spray coating tends to improve. In this regard, when the content of chromium in the iron-based alloy is 20% by mass or less, and more specifically 18% by mass or less, the abrasion resistance of the thermal spray coating is easily improved to a level that is particularly suitable in practice.

When the iron-based alloy contains nickel, the content of nickel in the iron-based alloy is preferably 5% by mass or more. As the content of nickel in the iron-based alloy increases, the corrosion resistance of the thermal spray coating formed from the thermal spray powder tends to improve. In this regard, when the content of nickel in the iron-based alloy is 5% by mass or more, the corrosion resistance of the thermal spray coating is easily improved to a level that is particularly suitable in practice.

On the other hand, the content of nickel in the iron-based alloy is preferably 20% by mass or less, and more preferably 18% by mass or less. As the content of nickel in the iron-based alloy decreases, the toughness of the thermal spray coating formed from the thermal spray powder increases, and as a result, the abrasion resistance of the thermal spray coating tends to improve. In this regard, when the content of nickel in the iron-based alloy is 20% by mass or less, and more specifically 18% by mass or less, the abrasion resistance of the thermal spray coating is easily improved to a level that is particularly suitable in practice.

When the iron-based alloy contains aluminum, the content of aluminum in the iron-based alloy is preferably 0.4% by mass or more, and more preferably 1% by mass or more. As the content of aluminum in the iron-based alloy increases, the corrosion resistance of the thermal spray coating formed from the thermal spray powder tends to improve. In this regard, when the content of aluminum in the iron-based alloy is 0.4% by mass or more, and more specifically 1% by mass or more, the corrosion resistance of the thermal spray coating is easily improved to a level that is particularly suitable in practice.

On the other hand, the content of aluminum in the iron-based alloy is preferably 5% by mass or less, and more preferably 3% by mass or less. As the content of aluminum in the iron-based alloy decreases, the toughness of the thermal spray coating formed from the thermal spray powder increases, and as a result, the abrasion resistance of the thermal spray coating tends to improve. In this regard, when the content of aluminum in the iron-based alloy is 5% by mass or less, and more specifically 3% by mass or less, the abrasion resistance of the thermal spray coating is easily improved to a level that is particularly suitable in practice.

When the iron-based alloy contains molybdenum, the content of molybdenum in the iron-based alloy is preferably 0.4% by mass or more, and more preferably 1% by mass or more. As the content of molybdenum in the iron-based alloy increases, the corrosion resistance of the thermal spray coating formed from the thermal spray powder Lends to improve. In this regard, when the content of molybdenum in the iron-based alloy is 0.4% by mass or more, and more specifically 1% by mass or more, the corrosion resistance of the thermal spray coating is easily improved to a level that is particularly suitable in practice.

On the other hand, the content of molybdenum in the iron-based alloy is preferably 5% by mass or less, and more preferably 3% by mass or less. As the content of molybdenum in the iron-based alloy decreases, the toughness of the thermal spray coating formed from the thermal spray powder increases, and as a result, the abrasion resistance of the thermal spray coating tends to improve. In this regard, when the content of molybdenum in the iron-based alloy is 5% by mass or less, and more specifically 3% by mass or less, the abrasion resistance of the thermal spray coating is easily improved to a level that is particularly suitable in practice.

When the iron-based alloy contains manganese, the content of manganese in the iron-based alloy is preferably in the range of 0.1 to 5% by mass, and more preferably in the range of 1 to 3% by mass. When the content of manganese in the iron-based alloy is within the above range, the corrosion resistance of the thermal spray coating formed from the thermal spray powder is easily improved to a level that is particularly suitable in practice.

The lower limit for the average particle diameter (volume average particle size) of the granulated and sintered cermet particles is preferably 5 μm, more preferably 8 μm, and further preferably 15 μm. As the average particle diameter of the granulated and sintered cermet particles increases, the amount of free fine particles contained in the thermal spray powder, which may be over-melted during thermal spraying, is smaller, and as a result, spitting is less likely to occur. The spitting means a phenomenon in which a deposit formed by adhesion and deposition of an over-melted thermal spray powder on an inner wall of a nozzle of a thermal spray apparatus drops from the inner wall during thermal spraying of the thermal spray powder and is mixed in the thermal spray coating. The phenomenon reduces the performance of the thermal spray coating. In this regard, when the average particle diameter of the granulated and sintered cermet particles is 5 μm or more, and more specifically 8 μm or more, or 15 μm or more, the occurrence of spitting during thermal spraying of the thermal spray powder is easily suppressed to a level that is particularly suitable in practice.

The upper limit for the average particle diameter of the granulated and sintered cermet particles is preferably 50 μm, more preferably 40 μm, and further preferably 30 μm. As the average particle diameter of the granulated and sintered cermet particles decreases, the denseness of the thermal spray coating formed from the thermal spray powder increases, and as a result, the hardness and the abrasion resistance of the thermal spray coating tend to improve. In this regard, when the average particle diameter of the granulated and sintered cermet particles is 50 μm or less, and more specifically 40 μm or less, or 30 μm or less, the abrasion resistance of the thermal spray coating is easily improved to a level that is particularly suitable in practice.

The lower limit for the compressive strength of the granulated and sintered cermet particles is preferably 100 MPa, more preferably 150 MPa, and further preferably 200 MPa. Granulated and sintered cermet particles with a higher compressive strength are less likely to disintegrate. Therefore, for a thermal spray powder including the granulated and sintered cermet particles with a higher compressive strength, the production of free fine particles, which may be over-melted during thermal spraying, by disintegration of the granulated and sintered cermet particles before thermal spraying is suppressed, and as a result, spitting is less likely to occur. In this regard, when the compressive strength of the granulated and sintered cermet particles is 100 MPa or more, and more specifically 150 MPa or more, or 200 MPa or more, the occurrence of spitting during thermal spraying of the thermal spray powder is easily suppressed to a level that is particularly suitable in practice.

The upper limit for the compressive strength of the granulated and sintered cermet particles is preferably 800 MPa, and more preferably 700 MPa. Granulated and sintered cermet particles with a lower compressive strength undergo heating by a heat source during thermal spraying to be easily softened or melted. Therefore, for a thermal spray powder including the granulated and sintered cermet particles with a lower compressive strength, the adhesion efficiency tends to improve. In this regard, when the compressive strength of the granulated and sintered cermet particles is 800 MPa or less, and more specifically 700 MPa or less, the adhesion efficiency of the thermal spray powder is easily improved to a level that is particularly suitable in practice.

A thermal spray powder according to the present embodiment, that is, granulated and sintered cermet particles can be produced, for example, as follows: first, ceramic particles including at least any one of tungsten carbide and chromium carbide and metal particles including a silicon-containing iron-based alloy are mixed in a dispersion medium to prepare a slurry. An appropriate binder may be added to the slurry. Then, the slurry is made into a granulated powder with a tumbling granulator, a spraying granulator, or a compression granulator. The granulated powder thus obtained is sintered, and as necessary further crushed into smaller particles and classified to produce granulated and sintered cermet particles. It is to be noted that the granulated powder may be sintered either in vacuum or in an inert gas atmosphere either with an electric furnace or with a gas furnace.

A thermal spray powder according to the present embodiment is mainly used in an application for forming a cermet thermal spray coating by high velocity flame thermal spraying such as high velocity air fuel (HVAF) thermal spraying or high velocity oxygen fuel (HVOF) thermal spraying. In particular, in the case of HVOF, a thermal spray coating excellent in hardness and abrasion resistance is easily formed from a thermal spray powder with high adhesion efficiency, compared with a high velocity flame thermal spraying method other than HVOF. Accordingly, HVOF is a preferable thermal spraying method.

According to the present embodiment, the following advantages are obtained.

In a thermal spray powder according to the present embodiment, a silicon-containing iron-based alloy is a substitute for cobalt. According to "Element strategy outlook: Material and fully alternative strategy" published by the National Institute for Materials Science, the crustal abundance of iron is about 2,000 tines that of cobalt, and that of silicon is about 22,000 times that of cobalt; the annual production of iron is about 25,000 times that of cobalt, and that of silicon is about 100 times that of cobalt; and the average price of iron and that of silicon are both about 0.03 times that of cobalt. This suggests that a thermal spray powder according to the present embodiment can be stably supplied at a low price since it contains a silicon-containing iron-based alloy as a substitute for cobalt.

In addition, silicon contained in a thermal spray powder according to the present embodiment is finely crystallized in a thermal spray coating to improve the lubricity of the thermal spray coating.

The present embodiment may be modified as follows.

The granulated and sintered cermet particles in the thermal spray powder may contain a component such as unavoidable impurities or additives, other than at least any one of tungsten carbide and chromium carbide, and a silicon-containing iron-based alloy.

The thermal spray powder may contain a component other than the granulated and sintered cermet particles, provided that the content of the component other than the granulated and sintered cermet particles is preferably as low as possible.

The thermal spray powder may be used in an application for forming a thermal spray coating by a thermal spraying method other than a high velocity flame thermal spraying method, such as a thermal spraying process at a relatively low temperature, for example, cold spraying and warm spraying processes, or a thermal spraying process at a relatively high temperature, for example, a plasma thermal spraying process.

Cold spraying is a technique for forming a coating by accelerating a working gas heated to a temperature lower than the melting point or softening temperature of a thermal spray powder to a supersonic speed, and allowing the thermal spray powder in a solid phase to collide with a substrate at a high speed with the accelerated working gas. In the case of a thermal spraying process at a relatively high temperature, since a thermal spray powder heated to a temperature equal to or higher than its melting point or softening temperature is blown toward a substrate, the substrate may undergo thermal alteration or deformation depending on its material and shape. Therefore, a coating cannot be formed on substrates of every material and shape, and thus a disadvantage of the thermal spraying process is that it limits the material and shape of the substrate. In addition, the thermal spray powder needs to be heated to a temperature equal to or higher than its melting point or softening temperature, resulting in large apparatuses and limited conditions such as construction places. In contrast, since cold spraying makes it possible to thermal-spray at a relatively low temperature, a substrate is unlikely to undergo thermal alteration or deformation, and thus an advantage of the cold spraying is that it can make some apparatuses smaller than the thermal spraying process at a relatively high temperature. Furthermore, the working gas to be used is not a combustion gas, and thus other advantages are excellent safety and high convenience for construction on site.

In general, cold spraying is classified into a high pressure type and a low pressure type depending on working gas pressure. That is, cold spraying when the upper limit for the working gas pressure is 1 MPa is referred to as low pressure cold spraying, and cold spraying when the upper limit for the working gas pressure is 5 MPa is referred to as high pressure cold spraying. In the case of the high pressure cold spraying, an inert gas such as a helium gas, a nitrogen gas, or a mixture thereof is mainly used as a working gas. In the case of the low pressure cold spraying, the same kind of gas as used in the high pressure cold spraying or a compressed air is used as a working gas.

When a thermal spray powder according to the present embodiment is used in an application for forming a thermal spray coating with the high pressure cold spraying, the working gas is supplied to the cold spray at a pressure of preferably 0.5 to 5 MPa, more preferably 0.7 to 5 MPa, further preferably 1 to 5 MPa, and most preferably 1 to 4 MPa, and heated to preferably 100 to 1,000° C., more preferably 300 to 1,000° C., further preferably 500 to 1,000° C., and most preferably 500 to 800° C. The thermal spray powder is supplied to the working gas from a direction coaxial with the working gas at a supply speed of preferably 1 to 200 g/min, and further preferably 10 to 100 g/min. During spraying, the distance from a tip of a nozzle of the cold spray to the substrate is preferably 5 to 100 mm, and more preferably 10 to 50 mm, and the traverse speed of the nozzle of the cold spray is preferably 10 to 300 mm/sec, and more preferably 10 to 150 mm/sec. The thickness of a thermal spray coating to be formed is preferably 50 to 1,000 μm, and more preferably 100 to 500 μm.

On the other hand, when a thermal spray powder according to the present embodiment is used in an application for forming a thermal spray coating with the low pressure cold spraying, the working gas is supplied to the cold spray at a pressure of preferably 0.3 to 1 MPa, more preferably 0.5 to 1 MPa, and most preferably 0.7 to 1 MPa, and heated to preferably 100 to 600° C., more preferably 250 to 600° C., and most preferably 400 to 600° C. The thermal spray powder is supplied to the working gas from a direction coaxial with the working gas at a supply speed of preferably 1 to 200 g/min, and further preferably 10 to 100 g/win. During spraying, the distance from a tip of a nozzle of the cold spray to the substrate is preferably 5 to 100 mm, and more preferably 10 to 40 mm, and the traverse speed of the nozzle of the cold spray is preferably 5 to 300 mm/sec, and more preferably 5 to 150 mm/sec. The thickness of a thermal spray coating to be formed is preferably 50 to 1,000 μm, more preferably 100 to 500 μm, and most preferably 100 to 300 μm.

Next, the present invention will be more specifically described with reference to Examples and Comparative Examples.

Examples 1 to 14 and Comparative Examples 1 and 2

Thermal spray powders according to Examples 1 to 14 and Comparative Examples 1 and 2 were prepared, each of which consisted of granulated and sintered cermet particles. The thermal spray powders were each thermally sprayed under one of first to third conditions shown in Table 1 to form a thermal spray coating with a thickness of 200 μm.

TABLE 1

| |
|---|
| First conditions |
| Thermal spray apparatus: HVOF thermal spray apparatus "JP-5000" manufactured by Praxair/TAFA Inc.<br>Flow rate of oxygen: 1,900 scfh (about 893 L/minute)<br>Flow rate of kerosene: 5.1 gph (about 0.32 L/minute)<br>Thermal spraying distance: 380 mm<br>Barrel length of thermal spray apparatus: 8 inches (about 203.2 mm) |
| Second conditions |
| Thermal spray apparatus: HVOF thermal spray apparatus "JP-5000" manufactured by Praxair/TAFA Inc.<br>Flow rate of oxygen: 2,100 scfh (about 989 L/minute)<br>Flow rate of kerosene: 6.5 gph (about 0.41 L/minute)<br>Thermal spraying distance: 380 mm<br>Barrel length of thermal spray apparatus: 8 inches (about 203.2 mm) |
| Third conditions |
| Thermal spray apparatus: HVOF thermal spray apparatus "JP-5000" manufactured by Praxair/TAFA Inc.<br>Flow rate of oxygen: 2,300 scfh (about 1,084 L/minute)<br>Flow rate of kerosene: 4.0 gph (about 0.25 L/minute)<br>Thermal spraying distance: 380 mm<br>Barrel length of thermal spray apparatus: 8 inches (about 203.2 mm) |

The thermal spray powders according to Examples 1 to 14 and Comparative Examples 1 and 2 as well as thermal spray coatings formed from the thermal spray powders are shown in Table 2 in detail.

TABLE 2

| | Type of ceramic component | Type of metal component | Content of metal component (mass %) | Average particle diameter D50 (μm) | Compressive strength (MPa) | Thermal spray conditions |
|---|---|---|---|---|---|---|
| Example 1 | WC | Alloy 1 | 12 | 30 | 550 | First conditions |
| Example 2 | WC | Alloy 2 | 12 | 30 | 473 | First conditions |

TABLE 2-continued

| | | | | | | |
|---|---|---|---|---|---|---|
| Example 3 | WC | Alloy 3 | 12 | 30 | 638 | First conditions |
| Example 4 | WC | Alloy 1 | 8 | 30 | 550 | First conditions |
| Example 5 | WC | Alloy 2 | 8 | 30 | 473 | First conditions |
| Example 6 | WC | Alloy 3 | 8 | 30 | 638 | First conditions |
| Example 7 | WC | Alloy 1 | 12 | 30 | 550 | Second conditions |
| Example 8 | WC | Alloy 2 | 12 | 30 | 473 | Second conditions |
| Example 9 | WC | Alloy 3 | 12 | 30 | 638 | Second conditions |
| Example 10 | WC | Alloy 1 | 12 | 30 | 550 | Third conditions |
| Example 11 | WC | Alloy 2 | 12 | 30 | 473 | Third conditions |
| Example 12 | WC | Alloy 3 | 12 | 30 | 638 | Third conditions |
| Comparative Example 1 | WC | Cobalt | 12 | 30 | 400 | First conditions |
| Comparative Example 2 | WC | Alloy 4 | 12 | 30 | 320 | First conditions |
| Example 13 | WC | Alloy 5 | 12 | 30 | 411 | First conditions |
| Example 14 | WC | Alloy 6 | 12 | 30 | 393 | First conditions |

| | Adhesion efficiency (%) | Hardness | Abrasion resistance | Surface roughness (μm) | Spitting | Corrosion resistance |
|---|---|---|---|---|---|---|
| Example 1 | 35.7 | 990 | 0.079 | 3.6 | None | Good |
| Example 2 | 39.7 | 955 | 0.066 | 3.0 | None | Fair |
| Example 3 | 46.6 | 1040 | 0.049 | 3.8 | None | Excellent |
| Example 4 | 30.8 | 1071 | 0.038 | 3.7 | None | Good |
| Example 5 | 27.9 | 1088 | 0.040 | 3.5 | None | Fair |
| Example 6 | 32.9 | 1131 | 0.029 | 3.9 | None | Excellent |
| Example 7 | 25.9 | 1326 | 0.069 | 2.8 | None | Good |
| Example 8 | 31.2 | 1206 | 0.053 | 2.7 | None | Fair |
| Example 9 | 39.2 | 1202 | 0.039 | 3.3 | None | Excellent |
| Example 10 | 29.4 | 834 | 0.087 | 3.9 | None | Good |
| Example 11 | 31.3 | 925 | 0.079 | 3.5 | None | Fair |
| Example 12 | 32.4 | 944 | 0.080 | 3.8 | None | Excellent |
| Comparative Example 1 | 43.0 | 1100 | 0.030 | 4.1 | None | Poor |
| Comparative Example 2 | 34.1 | 894 | 0.097 | 3.9 | None | Poor |
| Example 13 | 39.2 | 1021 | 0.051 | 3.6 | None | Good |
| Example 14 | 38.4 | 1016 | 0.053 | 3.6 | None | Good |

Examples 15 to 22 and Comparative Examples 3 to 7

Thermal spray powders according to Examples 15 to 22 and Comparative Examples 3 to 7 were prepared, each of which consisted of granulated and sintered cermet particles. The thermal spray powders were each thermally sprayed under fourth or fifth conditions shown in Table 3 to form a thermal spray coating.

TABLE 3

| Fourth conditions |
|---|
| Thermal spray apparatus: thermal spray apparatus for cold spraying "PCS-203" manufactured by Plasma Giken Co., Ltd. |
| Working gas: helium |
| Working gas pressure: 3.0 MPa |
| Working gas temperature: 600° C. |
| Thermal spraying distance: 15 mm |
| Traverse speed: 20 mm/sec |
| Number of passes: 1 pass |
| Feed rate of thermal spray powder: 50 g/minute |
| Substrate: SS400 |

TABLE 3-continued

| Fifth conditions |
|---|
| Thermal spray apparatus: thermal spray apparatus for cold spraying "Dymet" manufactured by OCPS (Russia) |
| Working gas: air |
| Working gas pressure: 0.7 MPa |
| Working gas heater temperature: 600° C. |
| Thermal spraying distance: 20 mm |
| Traverse speed: 5 mm/sec |
| Number of passes: 1 pass |
| Feed rate of thermal spray powder: 15 g/minute |
| Substrate: SS400 |

The thermal spray powders according to Examples 15 to 22 and Comparative Examples 3 to 7 as well as thermal spray coatings formed from the thermal spray powders are shown in Table 4 in detail.

TABLE 4

| | Type of ceramic component | Type of metal component | Content of metal component (mass %) | Average particle diameter D50 (μm) | Compressive strength (MPa) | Thermal spray conditions | Thickness (μm) | Hardness |
|---|---|---|---|---|---|---|---|---|
| Example 15 | WC | Alloy 1 | 30 | 15 | 352 | Fourth conditions | 90 | 998 |
| Example 16 | WC | Alloy 2 | 30 | 15 | 381 | Fourth conditions | 160 | 1004 |
| Example 17 | WC | Alloy 3 | 30 | 15 | 321 | Fourth conditions | 190 | 1081 |
| Example 18 | WC | Alloy 1 | 25 | 15 | 367 | Fourth conditions | 60 | 1149 |
| Example 19 | WC | Alloy 2 | 25 | 15 | 312 | Fourth conditions | 150 | 1138 |
| Example 20 | WC | Alloy 3 | 25 | 15 | 392 | Fourth conditions | 170 | 1213 |
| Comparative Example 3 | WC | Cobalt | 25 | 15 | 260 | Fourth conditions | 150 | 1078 |
| Comparative Example 4 | WC | Alloy 4 | 25 | 15 | 400 | Fourth conditions | 80 | 993 |
| Example 21 | WC | Alloy 3 | 30 | 15 | 337 | Fifth conditions | 220 | 661 |
| Example 22 | WC | Alloy 3 | 25 | 15 | 321 | Fifth conditions | 200 | 832 |
| Comparative Example 5 | WC | Alloy 4 | 25 | 15 | 400 | Fifth conditions | — | — |
| Comparative Example 6 | WC | Cobalt | 25 | 15 | 400 | Fifth conditions | — | — |
| Comparative Example 7 | — | Nickel | 100 | 20 | — | Fifth conditions | 250 | 200 |

TABLE 5

| | Alloy 1 | Alloy 2 | Alloy 3 | Alloy 4 | Alloy 5 | Alloy 6 |
|---|---|---|---|---|---|---|
| Iron | Balance | Balance | Balance | Balance | Balance | Balance |
| Silicon | 0.82% by mass | 0.26% by mass | 6.73% by mass | — | 4.01% by mass | 3.03% by mass |
| Chromium | 16.51% by mass | 1.06% by mass | 2.41% by mass | 0.43% by mass | 3.10% by mass | — |
| Manganese | 0.19% by mass | 0.85% by mass | 0.11% by mass | — | — | — |
| Nickel | 12.38% by mass | — | — | — | — | 4.0% by mass |
| Molybdenum | 2.1% by mass | 0.20% by mass | — | — | — | — |
| Unavoidable impurities | 0.152% by mass | 0.465% by mass | 3.244% by mass | 0.132% by mass | 0.147% by mass | 0.145% by mass |
| Liquid phase appearance temperature (melting point) | 1,200° C. | 1,260° C. | 1,030° C. | 1,270° C. | 1,110° C. | 1,150° C. |

The columns entitled "Type of ceramic component" in Table 2 and Table 4 show the type of a ceramic component in each thermal spray powder. In the columns, "WC" represents tungsten carbide and "–" indicates that no ceramic component was contained.

The columns entitled "Type of metal component" in Table 2 and Table 4 show the type of a metal component in each thermal spray powder. The compositions of alloys represented by "alloy 1", "alloy 2", "alloy 3", "alloy 4", "alloy 5", and "alloy 6" are shown in Table 5. The melting point, more accurately liquid phase appearance temperature of granulated and sintered cermet particles containing 12% by mass of each alloy and having the balance being tungsten carbide is also shown in Table 5. The liquid phase appearance temperature of the granulated and sintered cermet particles was calculated from a first endothermic peak measured with a thermal analysis apparatus "TG-DTA Thermo plus EVO" manufactured by Rigaku Corporation. The liquid phase appearance temperature of granulated and sintered cermet particles containing 12% by mass of cobalt and having the balance being tungsten carbide was 1,270° C. The melting point of cobalt used in Comparative Examples 1, 3 and 6 is 1,490° C., and the melting point of nickel used in Comparative Example 7 is 1,455° C.

The columns entitled "Content of metal component" in Table 2 and Table 4 show the content of a metal component in each thermal spray powder. It is to be noted that the ceramic component accounts for the balance of each thermal spray powder excluding the metal component.

The columns entitled "Average particle diameter D50" in Table 2 and Table 4 show the results obtained by measuring the average particle diameter (volume average particle size) of each thermal spray powder with a laser diffraction/scattering particle size measuring instrument "LA-300" (manufactured by HORIBA, Ltd.).

The columns entitled "Compressive strength" in Table 2 and Table 4 show the measurement results of the compressive strength of the granulated and sintered cermet particles contained in each thermal spray powder. Specifically, the compressive strength σ [MPa] of the granulated and sintered cermet particles, calculated according to the formula: $\sigma=2.8\times L/n/d^2$, is shown. In the formula, "L" represents the critical load [N], and "d" represents the average particle diameter

[mm] of the thermal spray powder. The critical load is the magnitude of a compressive load applied to the granulated and sintered cermet particles at the time of a rapid increase in the displacement of an indenter when a compressive load increased at a constant rate is applied to the granulated and sintered cermet particles by the indenter. This critical load was measured using a micro compression tester "MCTE-500" manufactured by Shimadzu Corporation.

The columns entitled "Thermal spray conditions" in Table 2 and Table 4 show the thermal spray conditions used in forming a thermal spray coating from each thermal spray powder (see Table 1 and Table 3).

The column entitled "Adhesion efficiency" in Table 2 shows the value resulting from dividing the weight of a thermal spray coating formed from each thermal spray powder by the weight of the used thermal spray powder, in terms of percentage.

The column entitled "Thickness" in Table 4 shows the thickness of a thermal spray coating formed from each thermal spray powder. In the column, "–" indicates that no coating could be formed.

The columns entitled "Hardness" in Table 2 and Table 4 show the results obtained by measuring the Vickers hardness (Hv 0.2) of a thermal spray coating formed from each thermal spray powder with a micro hardness measuring instrument "HMV-1" manufactured by Shimadzu Corporation. In the column, "–" indicates that no coating could be formed.

The column entitled "Abrasion resistance" in Table 2 shows the value obtained by dividing the abrasion volume of a thermal spray coating formed from each thermal spray powder, obtained by an abrasive wheel wear test according to Japanese Industrial Standards (JIS) H8682-1 (corresponding to ISO 8251) using a Suga abrasion tester, by the abrasion volume of a carbon steel SS400, obtained by the same abrasive wheel wear test.

The column entitled "Surface roughness" in Table 2 shows the results obtained by measuring the surface roughness of a thermal spray coating formed from each thermal spray powder with a stylus type surface roughness tester.

The column entitled "Spitting" in Table 2 shows whether the spitting occurred or not when each thermal spray powder was continuously thermally sprayed for 5 minutes.

The column entitled "Corrosion resistance" in Table 2 shows the results obtained by evaluating the corrosion resistance of a thermal spray coating formed from each thermal spray powder against a 0.5 mol % sulfuric acid aqueous solution according to a potential sweep test. In the column, "Excellent" indicates that the corrosion potential was −0.300 to −0.310 V, "Good" indicates that the corrosion potential was −0.311 to −0.320 V, "Fair" indicates that the corrosion potential was −0.321 to −0.330 V, and "Poor" indicates that the corrosion potential was −0.331 to −0.340 V.

The invention claimed is:

1. A thermal spray powder comprising granulated and sintered cermet particles, wherein the powder contains tungsten carbide or chromium carbide, and a silicon-containing iron-based alloy, wherein the alloy contains silicon in a content of about 3% to 10% by mass.

2. The thermal spray powder according to claim 1, wherein the alloy is contained in the thermal spray powder in a content of 5 to 40% by mass.

3. The thermal spray powder according to claim 2, wherein the alloy further contains 0.5 to 20% by mass of chromium.

4. The thermal spray powder according to claim 3, wherein the alloy further contains 5 to 20% by mass of nickel.

5. The thermal spray powder according to claim 4, wherein the alloy further contains at least one of aluminum, molybdenum, and manganese.

6. The thermal spray powder according to claim 5, wherein the tungsten carbide or chromium carbide accounts for the balance of the thermal spray powder excluding the alloy.

7. The thermal spray powder according to claim 2, wherein the alloy further contains 5 to 20% by mass of nickel.

8. The thermal spray powder according to claim 2, wherein the alloy further contains at least one of aluminum, molybdenum, and manganese.

9. The thermal spray powder according to claim 1, wherein the tungsten carbide or chromium carbide accounts for the balance of the thermal spray powder excluding the alloy.

10. A method of forming a thermal spray coating, comprising thermally spraying the thermal spray powder according to claim 1 by cold spraying to form the thermal spray coating.

11. A method of forming a thermal spray coating, comprising thermally spraying the thermal spray powder according to claim 1 by high pressure cold spraying to form the thermal spray coating.

12. A method of forming a thermal spray coating, comprising thermally spraying the thermal spray powder according to claim 1 by low pressure cold spraying to form the thermal spray coating.

13. The thermal spray powder according to claim 1, wherein the granulated and sintered cermet particles have a liquid phase appearance temperature of about 1,150 Corless.

14. The thermal spray powder according to claim 1, wherein the granulated and sintered cermet particles have a compressive strength of about 100 MPa to about 800 MPa.

* * * * *